US009953779B2

(12) United States Patent
Jung

(10) Patent No.: US 9,953,779 B2
(45) Date of Patent: Apr. 24, 2018

(54) BYPASS SWITCH

(71) Applicant: LSIS CO., LTD., Anyang-si, Gyeonggi-do (KR)

(72) Inventor: Teag Sun Jung, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 15/240,862

(22) Filed: Aug. 18, 2016

(65) Prior Publication Data

US 2017/0236663 A1 Aug. 17, 2017

(30) Foreign Application Priority Data

Feb. 16, 2016 (KR) ..... 10-2016-0018051

(51) Int. Cl.
*H01H 33/666* (2006.01)
*H01H 33/662* (2006.01)
(Continued)

(52) U.S. Cl.
CPC ..... *H01H 33/666* (2013.01); *H01H 33/662* (2013.01); *H01H 39/00* (2013.01);
(Continued)

(58) Field of Classification Search
CPC .... H01H 33/666; H01H 33/662; H01H 39/00; H01H 39/004; H01H 3/60; H01H 31/003; H01H 79/00
(Continued)

(56) References Cited

U.S. PATENT DOCUMENTS 5,055,640 A * 10/1991 Lippi ..... H01H 33/666 218/120
5,206,616 A * 4/1993 Stegmuller ..... H01H 33/666 218/136
(Continued)

FOREIGN PATENT DOCUMENTS

EP 0665568 8/1995
EP 2073229 6/2009
(Continued)

OTHER PUBLICATIONS

European Patent Office Application Serial No. 16183762.0, Search Report dated Jul. 18, 2017, 8 pages.
(Continued)

*Primary Examiner* — Renee Luebke
*Assistant Examiner* — William Bolton
(74) *Attorney, Agent, or Firm* — K&L Gates LLP

(57) ABSTRACT

A bypass switch includes: a casing; a vacuum interrupter disposed inside the casing, the vacuum interrupter being disposed such that a movable contact is movable to a fixed contact; a first fixing bus-bar fixed to the casing; a second fixing bus-bar fixed to the casing to be spaced apart from the first fixing bus-bar; a moving pusher connected to the movable contact; a drive source installed in the casing, the drive source pushing the moving pusher to a position at which the movable contact and the fixed contact are contacted with each other; and a multi-contactor disposed to be contacted with the moving pusher. Accordingly, the moving pusher can rapidly contact the movable contact with the fixed contact. Further, the moving pusher can be moved with a small external force. Thus, it is possible to minimize the size of the drive source and the power used in the drive source.

16 Claims, 8 Drawing Sheets

(51) Int. Cl.
*H01H 39/00* (2006.01)
*H01H 79/00* (2006.01)

(52) U.S. Cl.
CPC ..... *H01H 39/002* (2013.01); *H01H 39/004* (2013.01); *H01H 79/00* (2013.01); *H01H 2235/01* (2013.01)

(58) Field of Classification Search
USPC ..... 218/140, 139, 118, 154, 120, 123, 124, 218/126, 153, 57; 335/126, 201
See application file for complete search history.

(56) References Cited

U.S. PATENT DOCUMENTS

| | | | | |
|---|---|---|---|---|
| 5,438,173 | A | 8/1995 | Rudoy et al. | |
| 5,512,724 | A * | 4/1996 | Binder | H01H 33/666 218/140 |
| 5,514,844 | A * | 5/1996 | Hamano | H01H 33/901 218/57 |
| 5,661,281 | A | 8/1997 | Fieberg et al. | |
| 6,326,872 | B1 * | 12/2001 | Marchand | H01H 9/12 335/202 |
| 6,853,525 | B2 | 2/2005 | Hetzmannseder et al. | |
| 6,870,451 | B1 | 3/2005 | Inoue | |
| 6,930,271 | B1 * | 8/2005 | Palmieri | H01H 33/6662 218/154 |
| 8,390,968 | B2 | 3/2013 | Dorn et al. | |
| 2009/0218319 | A1 * | 9/2009 | Kagawa | H01H 33/6606 218/140 |
| 2011/0226740 | A1 | 9/2011 | Anheuer et al. | |
| 2012/0276755 | A1 * | 11/2012 | Sato | C10M 169/02 439/3 |
| 2016/0203929 | A1 | 7/2016 | Jung | |

FOREIGN PATENT DOCUMENTS

| | | | |
|---|---|---|---|
| EP | 3043368 | | 7/2016 |
| JP | S52115856 | U | 9/1977 |
| JP | S52151632 | | 12/1977 |
| JP | S5477974 | U | 6/1979 |
| JP | S61116934 | | 6/1986 |
| JP | S63023743 | U | 7/1986 |
| JP | H01279528 | | 11/1989 |
| JP | 8-511649 | | 12/1996 |
| JP | 200538630 | | 2/2005 |
| JP | 2005197094 | | 7/2005 |
| JP | 2010272445 | A | 12/2010 |
| KR | 10-0260609 | | 7/2000 |
| KR | 20110091520 | A | 8/2011 |

OTHER PUBLICATIONS

Japan Patent Office Application No. 2016-176455, Office Action dated Aug. 29, 2017, 3 pages.
Korean Office Action for related Korean Application No. 10-2016-0018051; action dated Oct. 31, 2017; (40 pages).
Japanese Office Action for related Japanese Application No. 2016-176455; action dated Feb. 6, 2018; (2 pages).

* cited by examiner

BYPASS SWITCH

CROSS-REFERENCE TO RELATED APPLICATIONS

Pursuant to 35 U.S.C. § 119(a) and 35 U.S.C. § 365(b), this application claims the benefit of earlier filing date and right of priority to Korean Application No. 10-2016-0018051, filed on Feb. 16, 2016, the contents of which are all hereby incorporated by reference herein in its entirety.

BACKGROUND

The present disclosure relates to a bypass switch, and more particularly, to a bypass switch having a vacuum interrupter in which a movable contact is moved to a fixed contact to be contacted with the fixed contact.

A bypass switch is installed in an electronic device such as converter. If an abnormality such as a failure occurs, the bypass switch is short-circuited, to minimize influence caused by the failure on other components installed in the electronic device.

The bypass switch may be provided in a converter used in a high voltage direct current (HVDC) transmission system, or may be provided in a static synchronous compensator (STATCOM) or a static var compensator (SVC). The bypass switch may be used as a high-speed short-circuit bypass switch that is short-circuited at high speed.

The HVDC transmission system is a transmission system in which, after a transmission site converts AC power produced at a power station into DC power and then transmits the DC power, a reception site re-converts DC power into AC power and then supplies power.

The STATCOM is a device that is used as a reactive/active power compensator in a power system when electricity is transmitted/distributed, and increases stability by compensating for a loss voltage.

The bypass switch may be provided in a converter including a combination of a plurality of sub-modules. In this case, if an abnormality such as a failure of a sub-module is detected, the bypass switch allow the sub-module of which failure is detected to be short-circuited, so that it is possible to prevent influence caused by the failure on adjacent other sub-modules.

The failure of the sub-module may be detected when there is no feedback signal from the sub-module, when a voltage of a designed value or more is applied to the sub-module, when a communication function of the sub-module is abnormal, when a driver of the sub-module is false, and the like.

The bypass switch may include a movable contact and a fixed contact. The bypass switch may further include a first bus-bar connected to the fixed contact and a second bus-bar connected to the movable contact. If an external force is applied to the movable contact, the movable contact is moved to the fixed contact to be contacted with the fixed contact.

The bypass switch may further include a drive source that generates a drive force for moving the movable contact. When the drive source is driven, the movable contact is moved to the fixed contact to be contacted with the fixed contact.

When the contact between the movable contact and the fixed contact occurs as the drive source is driven as described above, current may flow through the first bus-bar, the fixed contact, the movable contact, and the second bus-bar, and the bypass switch may be short-circuited.

PRIOR ART DOCUMENT

Patent Document

U.S. Pat. No. 8,390,968 B2 (published on Mar. 5, 2013)

SUMMARY

Embodiments provide a bypass switch which can minimize the size and power of a drive source and allow a movable contact to be contacted with a fixed contact by rapidly moving the movable contact to the fixed contact.

In one embodiment, a bypass switch includes: a casing; a vacuum interrupter disposed inside the casing, the vacuum interrupter being disposed such that a movable contact is movable to a fixed contact; a first fixing bus-bar fixed to the casing; a second fixing bus-bar fixed to the casing to be spaced apart from the first fixing bus-bar; a moving pusher connected to the movable contact; a drive source installed in the casing, the drive source pushing the moving pusher to a position at which the movable contact and the fixed contact are contacted with each other; and a multi-contactor disposed to be contacted with the moving pusher.

The multi-contactor may include: an outer body part surrounding the outer circumference of the moving pusher, the outer body part being spaced apart from the moving pusher; and a contact part protruding from the outer body part to be contacted with the moving pusher.

The contact part may be provided in plurality, and the plurality of contact parts may be formed to be spaced apart from each other in the circumferential direction of the outer body part.

The contact part may be provided in plurality, and the plurality of contact parts may be formed to be spaced apart from each other in the length direction of the outer body part.

The multi-contactor may include: an outer body part surrounding the outer circumference of the moving pusher, the outer body part being spaced apart from the moving pusher; a spiral contact part spirally protruding along the inner circumference of the outer body part to be contacted with the moving pusher.

The moving pusher may include: a moving part extending rod connected to the movable contact; and a latch plate connected to the moving part extending rod. The contact part may be contacted with the moving part extending rod.

The contact part may be formed long in a direction parallel to the length direction of the moving part extending rod.

A magnet allowing the movable contact to be spaced apart from the fixed contact by applying an attractive force to the latch plate may be disposed inside the casing. When the drive source is driven, a piston may be driven to apply, to the latch plate, an external force greater than the attractive force.

The latch plate may include: a pin to which the piston applies an external force; and a plate body facing at least one portion of the magnet. A pin insertion part in which an insertion hole having the pin inserted thereinto is formed may be formed at one surface of the plate body, and a connecting part connected to the moving part extending rod may be formed at the other surface of the plate body.

The bypass switch may include a magnet holder disposed inside the casing to fix the magnet.

The bypass switch may further include a spring elastically supporting the latch plate in the direction in which the movable contact and the fixed contact are contacted with each other.

A spring seat part may be formed in the magnet holder. A portion of the spring may be inserted and accommodated in the spring seat part, and the spring seat part may support the spring.

The casing may include a multi-contactor supporter supporting the multi-contactor, the multi-contactor supporter being formed of a conductive material.

A projection by which the multi-contactor is held may protrude from the inner circumference of the multi-contact supporter.

The multi-contactor may include: an outer body part surrounding the outer circumference of the moving pusher, the outer body part being spaced apart from the moving pusher; and a contact part protruding from the outer body part to be contacted with the moving pusher. The outer body part may include a hollow cylindrical body surrounding a portion of the moving pusher. The hollow cylindrical body may be disposed to be spaced apart from the moving pusher between the moving pusher and the multi-contactor supporter. The contact part may be a protrusion protruding from the inner circumference of the hollow cylindrical body.

The hollow cylindrical body may have a bore spaced apart from an outer surface of the moving pusher.

The casing may further include: a first conductive casing coupled to the fixed contact and the first fixing bus-bar; and a second conductive casing coupled to the multi-contactor supporter and the second fixing bus-bar.

A hollow cylindrical body surrounding a portion of the drive source may protrude from the second conductive casing. A hollow cylindrical body through-hole through which the hollow cylindrical body passes may be formed in the second fixing bus-bar.

The second fixing bus-bar may include: a contact plate body contacted with the second conductive casing; and a bending part bent from the contact plate body, the bending part being parallel to the direction in which the drive source protrudes to the outside.

The casing may further include an insulative casing disposed between the multi-contactor supporter and the first conductive casing. The insulative casing may surround the vacuum interrupter at the outside of the vacuum interrupter.

The multi-contactor supporter may be disposed between the second conductive casing and the insulative casing.

A fastening member through-hole through which a fastening member fastening the first conductive casing to the insulative casing passes may be formed in the first conductive casing. The first fixing bus-bar may cover the fastening member through-hole and the fastening member.

The first conductive casing may be fastened to the fixed contact by a fastening member.

An avoiding hole for avoiding the fastening member may be formed in the first fixing bus-bar.

According to the present disclosure, the moving pusher can rapidly contact the movable contact with the fixed contact. Further, the moving pusher can be moved with a small external force. Thus, it is possible to minimize the size of the drive source and the power used in the drive source.

Also, both the first fixing bus-bar and the second fixing bus-bar are fixedly installed, thereby facilitating assembling and maintenance. Further, a space for moving the first fixing bus-bar or the second fixing bus-bar is not required, thereby improving the utilization of spaces around the bypass switch.

Also, the fixed state of the latch plate can be maintained by the magnet, thereby minimizing malfunction of the bypass switch.

Also, after the drive source is driven, the latch plate is elastically supported by the spring, thereby minimizing separation of the movable contact from the fixed contact.

Also, the multi-contactor is not pushed by the moving part extending rod, and the position of the multi-contactor is maintained, thereby improving the reliability of the bypass switch.

Also, the moving part extending rod is moved in a state in which the contact between the multi-contactor and the moving part extending rod is continuously maintained, thereby improving the reliability of the bypass switch.

Also, the second fixing bus-bar and the first fixing bus-bar are not located on the circumferential surface of the casing but located to be spaced apart from each other at both sides of the casing, thereby improving the utilization spaces around the outer circumferential surface of the casing.

Also, the multi-contactor supporter and the second conductive casing, which form the external appearance of the bypass switch, allow the multi-contactor and the second fixing bus-bar to be electrically conducted. Thus, it is possible to minimize the number of parts as compared with when a separate conductive member allows the multi-contactor and the second fixing bus-bar to be electrically conducted, and to simplify the structure of the bypass switch.

Also, the first conductive casing forming the external appearance of the bypass switch allows the fixed contact and the first fixing bus-bar to be electrically conducted. Thus, it is possible to minimize the number of parts as compared with when a separate conductive member allows the fixed contact and the first fixing bus-bar to be electrically conducted, and to simplify the structure of the bypass switch.

Also, since the vacuum interrupter is installed inside the insulative casing forming the external appearance thereof, the vacuum interrupter is protected by the insulative casing. Thus, it is possible to minimize damage of the vacuum interrupter.

DETAILED DESCRIPTION OF THE EMBODIMENTS

Reference will now be made in detail to the embodiments of the present disclosure, examples of which are illustrated in the accompanying drawings.

Figure 1:
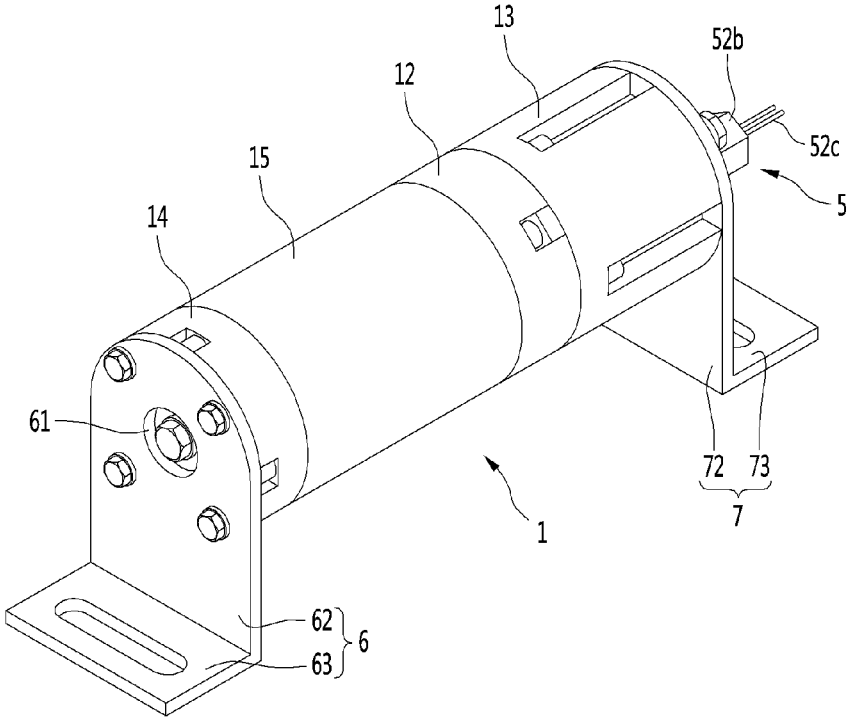
FIG. 1 is a perspective view showing a bypass switch according to a first embodiment.
Figure 2:
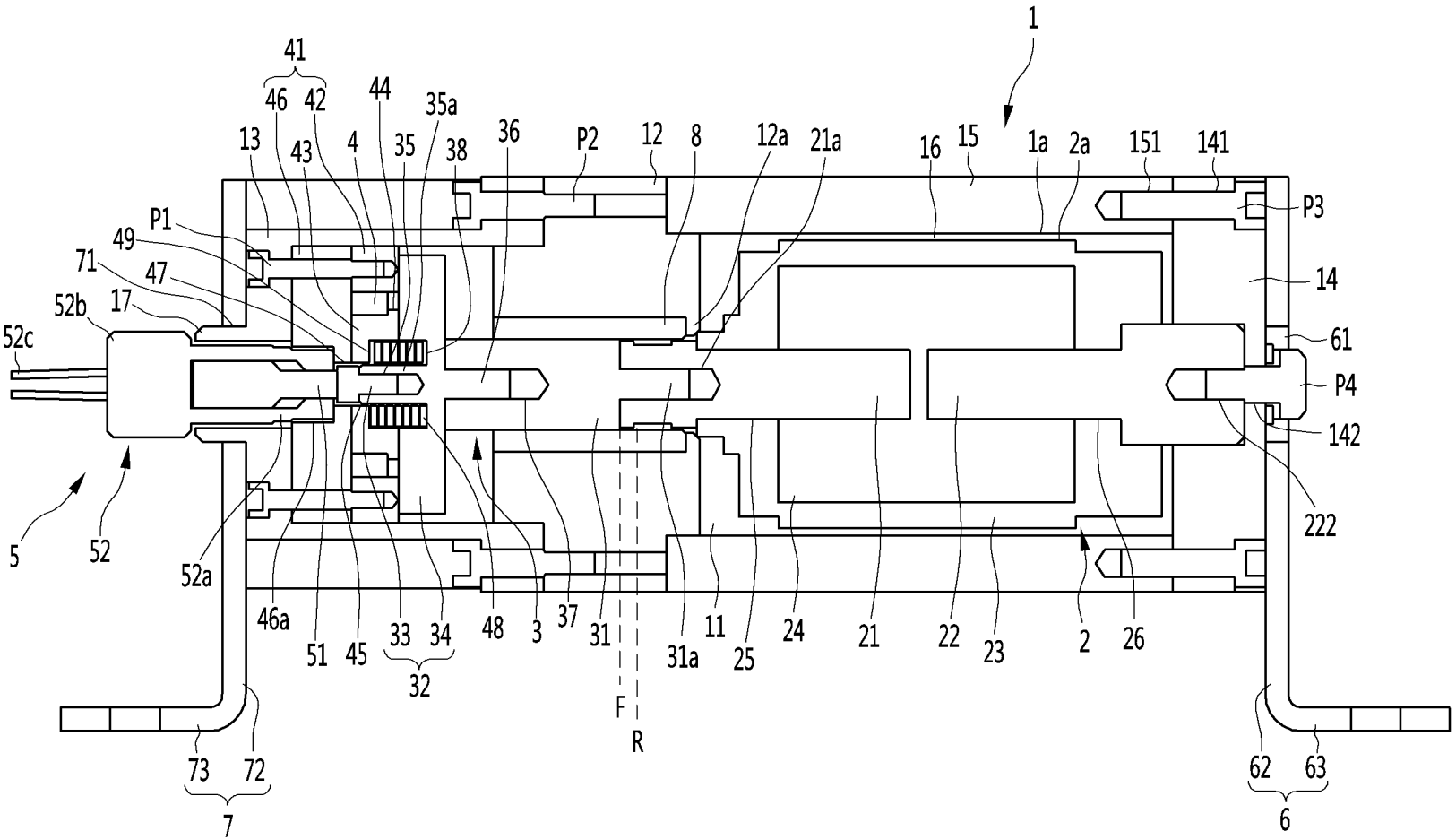
FIG. 2 is a longitudinal sectional view of the bypass switch before the bypass switch is operated according to the first embodiment.
Figure 3:
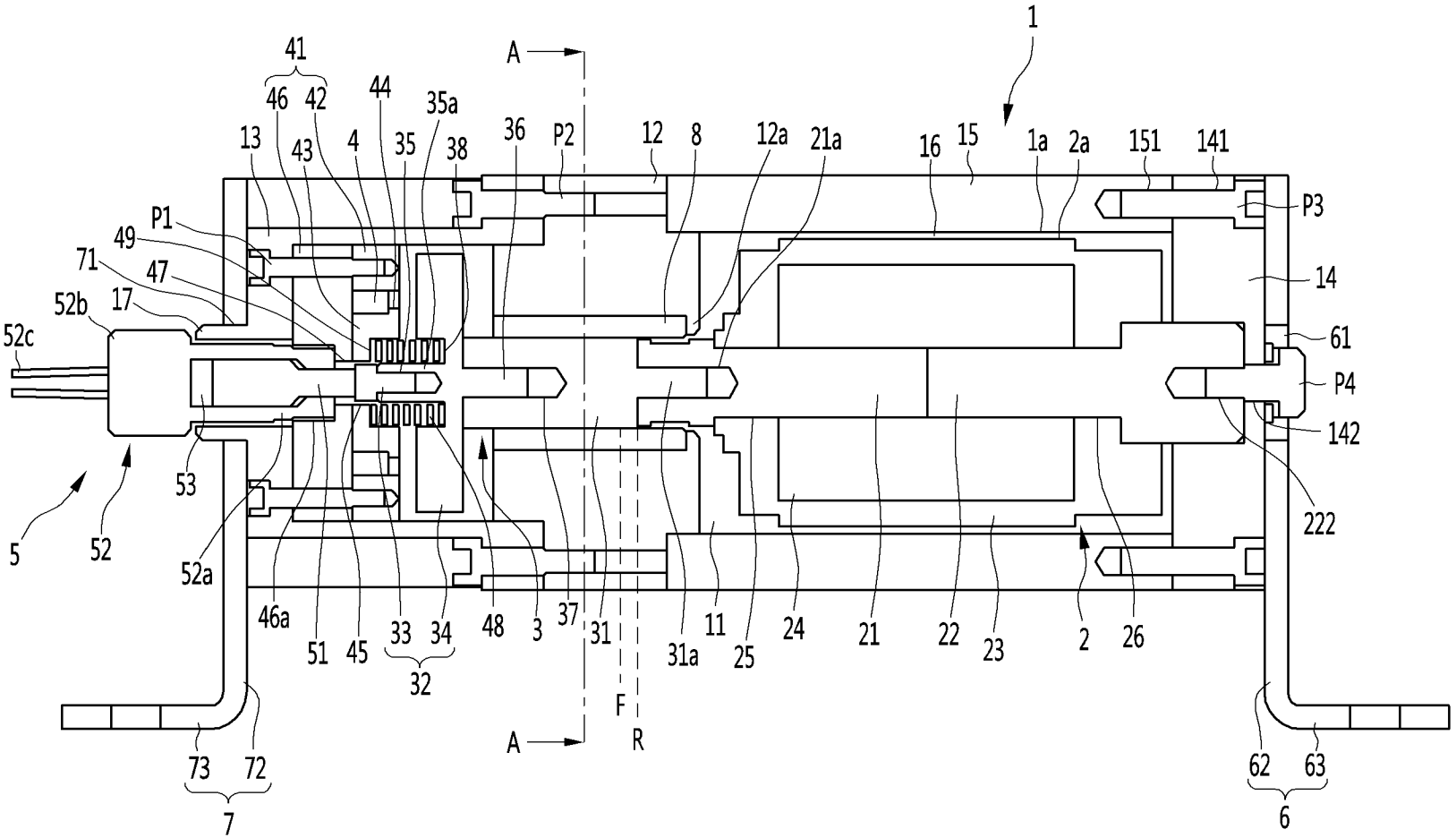
FIG. 3 is a longitudinal sectional view of the bypass switch after the bypass switch is operated according to the first embodiment.
Figure 4:
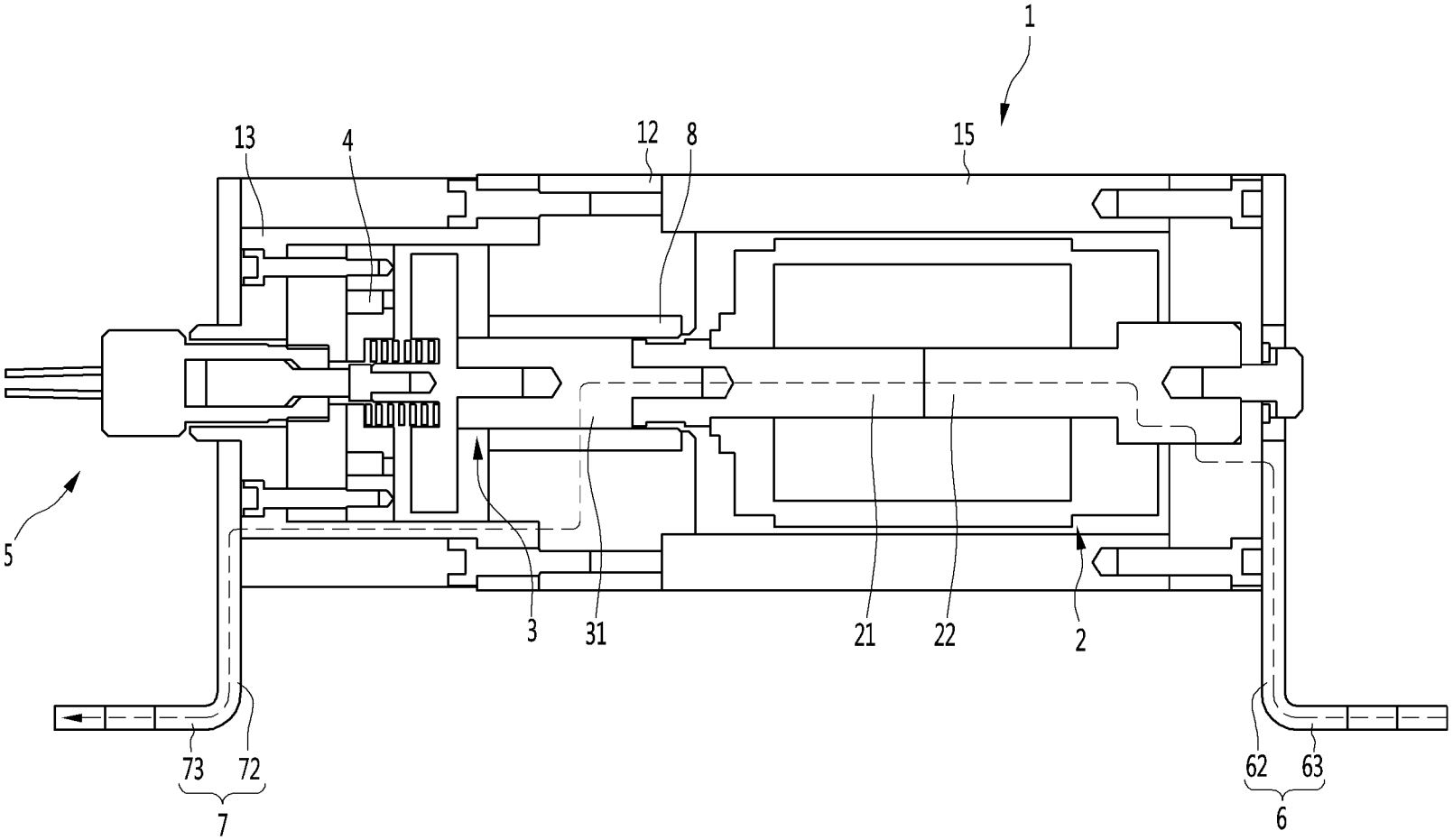
FIG. 4 is a longitudinal section view showing a flow of current after the bypass switch is operated according to the first embodiment.
Figure 5:
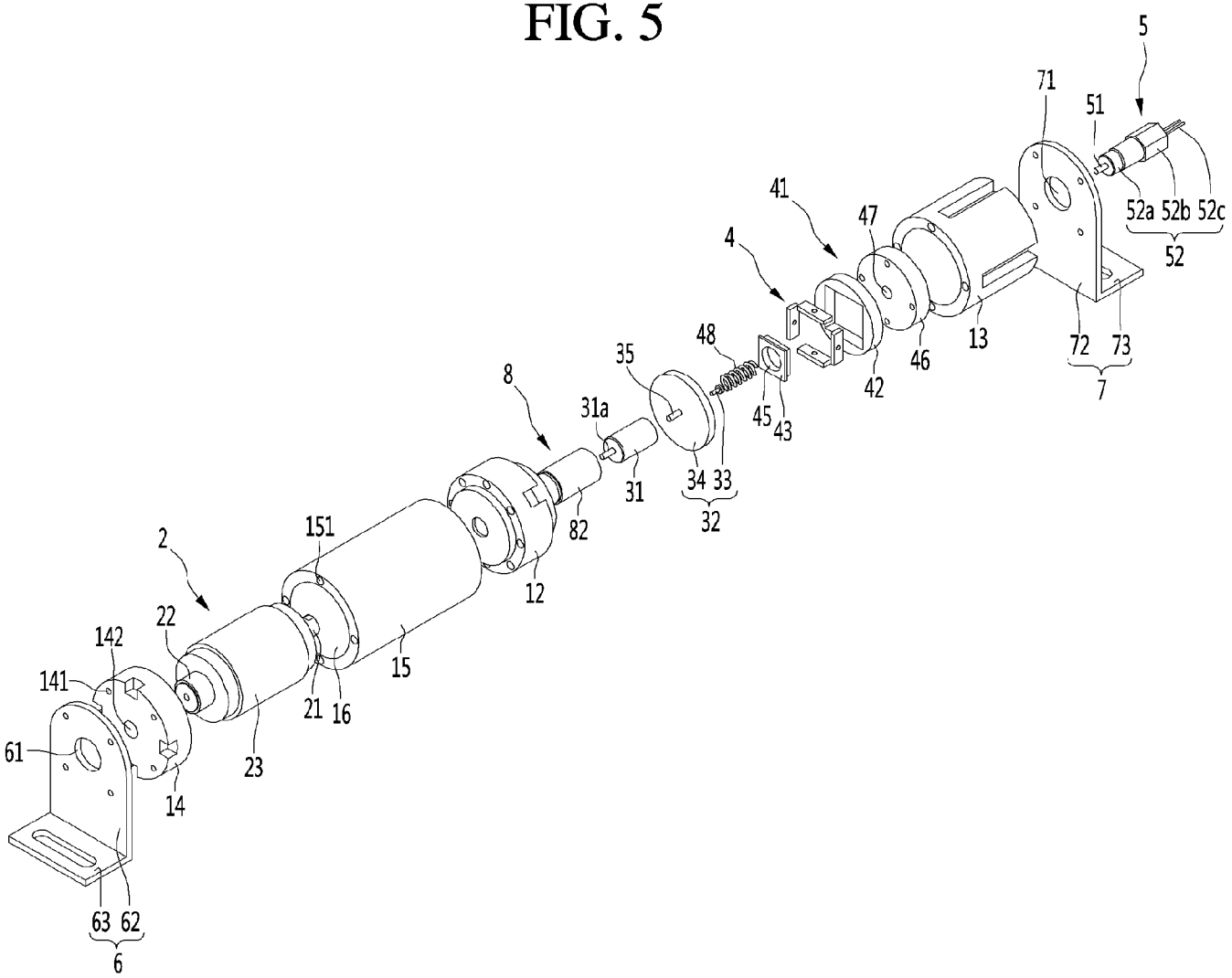
FIG. 5 is an exploded perspective view of the bypass switch according to the first embodiment.
Figure 6:
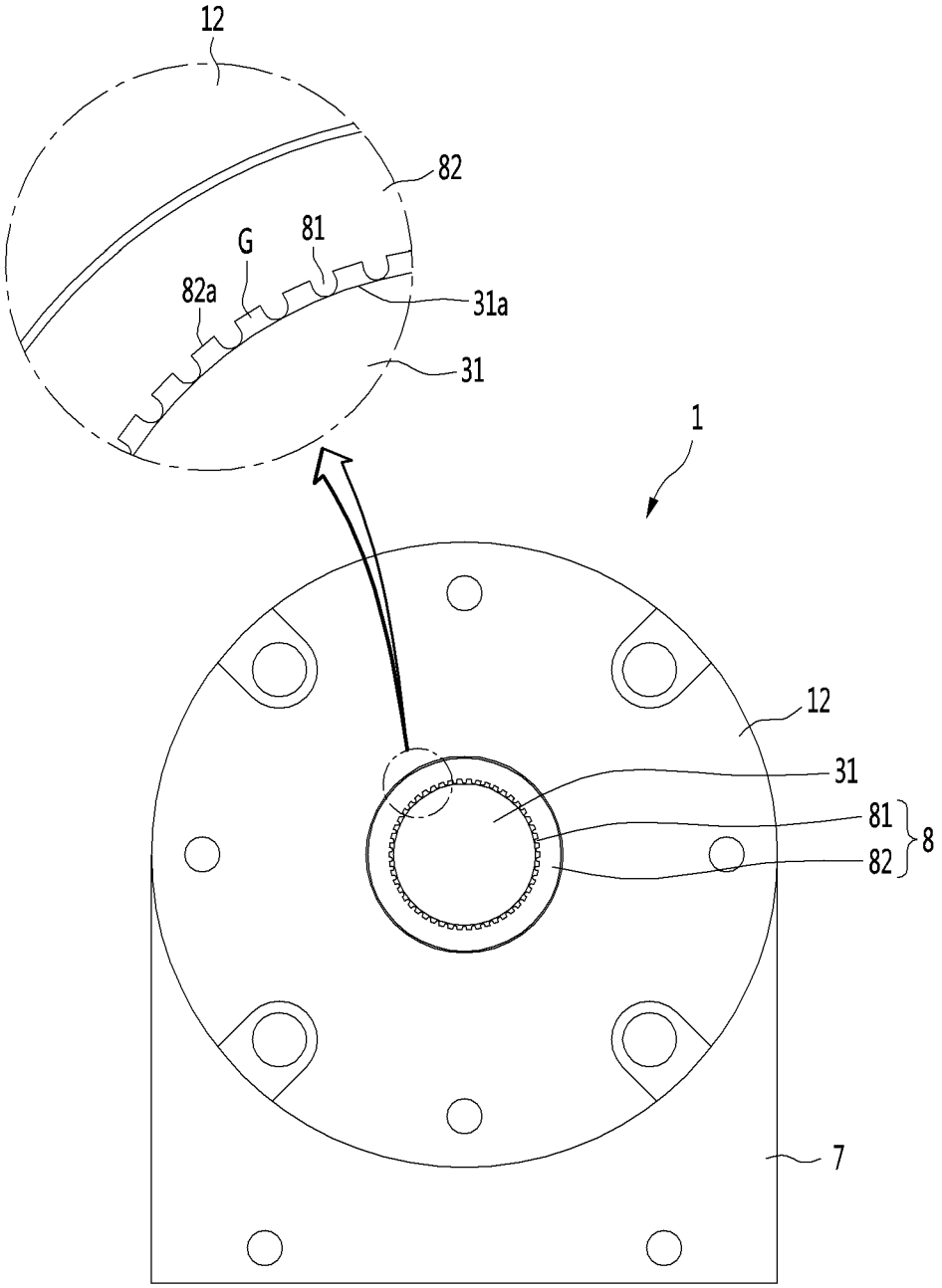
FIG. 6 is an enlarged sectional view taken along line A-A shown in FIG. 3.

FIG. 1 is a perspective view showing a bypass switch according to a first embodiment. FIG. 2 is a longitudinal sectional view of the bypass switch before the bypass switch is operated according to the first embodiment. FIG. 3 is a longitudinal sectional view of the bypass switch after the bypass switch is operated according to the first embodiment. FIG. 4 is a longitudinal section view showing a flow of current after the bypass switch is operated according to the first embodiment. FIG. 5 is an exploded perspective view of the bypass switch according to the first embodiment. FIG. 6 is an enlarged sectional view taken along line A-A shown in FIG. 3.

The bypass switch may include a casing 1, a vacuum interrupter 2, a moving pusher 3, a magnet 4, a drive source 5, a first fixing bus-bar 6, a second fixing bus-bar 7, and a multi-contactor 8.

The casing 1 may form the external appearance of the bypass switch. The casing 1 may be configured as an assembly of a plurality of members. The casing 1 may include a conductive casing made of a conductive material such as aluminum and an insulative casing made of an insulative material such as a synthetic resin. The casing 1 may be configured as an assembly of at least one conductive casing and at least one insulative casing. The casing 1 may include a plurality of conductive casings. The insulative casing may be disposed between the plurality of conductive casings.

A space 11 may be formed inside the casing 1. The vacuum interrupter 2, the moving pusher 3, the magnet 4, and the multi-contactor 8 may be provided in the space 11.

In the vacuum interrupter 2, a movable contact 21 may be disposed to be movable to a fixed contact 22.

The vacuum interrupter 2 may be disposed inside the casing 1. The vacuum interrupter 2 may be disposed in the space 11 of the casing 1, and may be protected by the casing 1. An outer circumferential surface 2*a* of the vacuum interrupter 2 may face an inner surface 1*a* of the casing 1.

The vacuum interrupter 2 may include an inner housing 23. The inner housing 23 may form the external appearance of the vacuum interrupter 2. The inner housing 23 may be a vacuum housing inside which an inner space 24 is formed.

The movable contact 21 may be disposed to be movable in the inner housing 23. A movable contact through-hole 25 through which the movable contact 21 movably passes may be formed in the inner housing 23.

The fixed contact 22 may be installed to be fixed to the inner housing 23. A fixed contact through-hole 26 through which the fixed contact 22 passes may be formed in the inner housing 23. The fixed contact through-hole 26 may be formed at a position at which it faces the movable contact through-hole 25.

The inner housing 23 may be formed long in the length direction of the casing 1 inside the casing 1. The outer circumferential surface 2*a* of the inner housing 23 may become an outer circumferential surface of the vacuum interrupter 2. The outer circumferential surface 2*a* of the inner housing 23 may face the inner surface 1*a* of the casing 1.

The moving pusher 3 may be connected to the movable contact 21 to move the movable contact 21. The movable contact 21 may be contacted with or separated from the fixed contact 22 when the moving pusher 3 is moved. The moving pusher 3 may locate the movable contact 21 such that the movable contact 21 is contacted with the fixed contact 22. The moving pusher 3 may locate the movable contact 21 such that the movable contact 21 is spaced apart from the fixed contact 22.

Before the drive source 5 is driven, the moving pusher 3, as shown in FIG. 2, may be kept at a first position F at which it allows the movable contact 21 to be spaced apart from the fixed contact 22. When the drive source 5 is driven, the moving pusher 3, as shown in FIG. 3, may be moved at which it allows the movable contact 21 to be contacted with the fixed contact 22.

The moving pusher 3 may be disposed between the drive source 5 and the movable contact 21 to push the movable contact 21 such that the movable contact 21 is contacted with the fixed contact 22 when the drive source 5 is driven. The moving pusher 3 may be a movable contact connector connected to the movable contact 21. The moving pusher 3 may constitute, together with the movable contact 21, a moving assembly.

The moving pusher 3 may be configured with one member or an assembly of a plurality of members.

The moving pusher 3 may include a moving part extending rod 31 connected to the movable contact 21. The moving part extending rod 31 may be connected to the movable contact 21 such that the whole or a portion of the moving part extending rod 31 is located at the outside of the vacuum interrupter 2.

The moving part extending rod 31 may be integrally formed with the movable contact 21, or may be formed as a separate member from the movable contact 21 to be connected to the movable contact 21. When the moving part extending rod 31 is connected to the movable contact 21, a protruding part 31*a* protruding from the moving part extending rod 31 may be inserted into a protruding part insertion groove part 21*a* formed in the movable contact 21, and the moving part extending rod 31 and the movable contact 21 may be integrally moved.

When the moving part extending rod 31 is connected to the movable contact 21, a protruding part insertion groove part may be formed in the moving part extending rod 31. It will be apparent that a protruding part protruding from the movable contact 21 may be inserted into the protruding part insertion groove part of the moving part extending rod 31.

The moving pusher 3 may include a latch plate 32 connected to the moving part extending rod 31. The latch plate 32 may be located to be movable inside the casing 1. The latch plate 32 may be disposed to be movable between the vacuum interrupter 2 and the drive source 5.

When an external force does not act on the latch plate 32, the latch plate 32, as shown in FIG. 2, may be located close to the magnet 4 by the action of an attractive force of the magnet 4. Before the drive source 5 is driven, the latch plate 32, as shown in FIG. 2, may be disposed to be adhered closely to a magnet holder 41 for fixing the magnet 4.

The latch plate 32 may be configured with a single member or a plurality of members. When the latch plate 32 is configured with a plurality of members, the latch plate 32 may include a pin 33 to which a piston 51 of the drive source 5, which will be described later, applies an external force, and a plate body 34 facing at least one portion of the magnet 4.

The plate body 34 may be made of a magnetic substance, and the attractive force of the magnet 4 may act on the plate body 34. If a separate external force does not act on the plate body 34, the plate body 34 may be pulled by the magnet 4 in the direction in which the magnet 4 is located.

A pin insertion part 35 may be formed at one surface of the plate body 34, and an insertion hole 35*a* into which the pin 33 is inserted may be formed in the pin insertion part 35. A connecting part 36 connected to the moving part extending rod 31 may be formed at the opposite surface of the plate body 34.

The plate body 34 may be formed as a plate in a disk shape. The pin insertion part 35 may protrude toward the drive source 5 from one surface of the plate, and the connecting part 36 may protrude toward the vacuum interrupter 2 from the opposite surface of the plate.

A portion of the pin 33 may be inserted into the pin insertion part 35 of the plate body 34. The pin 33 may be disposed such that a portion of the pin 33, which is located at the outside of the pin insertion part 35 of the plate body 34, faces the piston 51 of the drive source 5.

The pin insertion part 35 may protrude toward the drive source 5 from a surface facing the magnet 4 among both surfaces of the plate body 34.

The connecting part 36 may protrude toward the moving part extending rod 31 from the opposite surface to the surface facing the magnet 4 among both the surfaces of the plate body 34. A connecting part insertion groove part 37 into which the connecting part 36 is inserted may be formed in the moving part extending rod 31, and the latch plate 32 may be fixed as the connecting part 36 formed at the plate body 34 is inserted into the connecting part insertion groove part 37 formed in the moving part extending rod 31.

The latch plate 32 may constitute, together with the moving part extending rod 31, the moving pusher 3. When the drive source 5 is driven, the latch plate 32 may push the moving part extending rod 31, and the moving part extending rod 31 may push the movable contact 21.

The magnet 4 may be disposed inside the casing 1 to allow an attractive force to act on the latch plate 32. When an external force does not act on the latch plate 32, the magnet 4 may attract the latch plate 32 by allowing a magnetic force to act on the latch plate 32, and therefore, the movable contact 21 and the fixed contact 22 may be spaced apart from each other.

The magnet 4 may be formed in a ring or rod shape. The magnet 4 may be configured with one ring-shaped member or a plurality of rod-shaped members.

The magnet holder 41 for fixing the magnet 4 may be disposed inside the casing 1. The magnet holder 41 may include an outer holder 42 facing an inner circumferential surface of the casing 1 and an inner holder 43 located at the inside of the outer holder 42. The magnet holder 41 may be configured as a magnetic body, particularly, a weak magnetic body.

A space may be formed inside the outer holder 42, and the inner holder 43 may be located in the space of the outer holder 42 to be spaced apart from the outer holder 42.

The magnet 4 may be inserted into a gap between the outer holder 42 and the inner holder 43 to fit between the outer holder 42 and the inner holder 43.

A stopper by which the magnet 4 is held may be formed to protrude at the outer circumference of the inner holder 43.

A through-hole 45 through which the pin insertion part 35 and the pin 33 are located to pass may be formed in the inner holder 43.

The magnet holder 41 may be a magnet housing that surrounds the magnet 4 except its surface facing the plate body 34.

The magnet holder 41 may further include a side holder 46 that faces the outer holder 42, the magnet 4, and the inner holder 43. The magnet 4 may be installed such that its position is fixed between the side holder 46 and the stopper 44.

The side holder 46 may be fastened to at least one of the outer holder 42 and the inner holder 43 by a fastening member P1 such as a screw.

A guide hole 47 for guiding at least one of the pin 33 and the piston 51 which will be described later may be formed in the side holder 46. The guide hole 47 may be formed to face the through-hole 45 of the inner holder 43.

Before the drive source 5 is driven, a portion of the pin 33 may be located in the guide hole 47. When the drive source 5 is driven, the pin 33 may advance toward the vacuum interrupter 2 while being guided through the guide hole 47. The side holder 46 may be a pin guide for guiding the pin 33. A drive source accommodating groove 46*a* in which a portion of the drive source 5 is inserted and accommodated may be formed in the side holder 46. The drive source accommodating groove 46*a* may be formed in a depressed shape in one of both surfaces of the side holder 46, which faces a second conductive casing 13 which will be described above.

The bypass switch may further include a spring 48 for elastically supporting the latch plate 32 in the direction in which the movable contact 21 and the fixed contact 22 are contacted with each other.

The spring 48 may support the plate body 34 in the direction of the vacuum interrupter 2 such that, when the movable contact 21 and the fixed contact 22 are contacted with each other, the contact state is maintained without separating the movable contact 21 from the fixed contact 22.

The spring 48 may be configured as a coil spring having one end contacted with the plate body 34 and the other end contacted with the magnet holder 41.

Before the drive source 5 is driven, the spring 48, as shown in FIG. 2, may be compressed by being pressed by the latch plate 32 pulled by the magnet 4. If the drive source 5 is driven to push the latch plate 32 in the direction of the vacuum interrupter 2, the spring 48, as shown in FIG. 3, may be elastically restored, and thus can prevent the latch plate 32 from returning in a direction opposite to that of the vacuum interrupter 2, i.e., the direction of the magnet 4.

The spring 48 may be located at an outside of the pin insertion part 35 and an outside of the pin 33. The spring 48 may be located to surround the outside of the pin insertion part 35 and the outside of the pin 33.

A spring seat part 49 may be formed in the magnet holder 41. Here, one side of the spring 48 is inserted and accommodated in the spring seat part 49, and the spring seat part 49 supports the spring 48. The spring seat part 49 may be formed in the inner holder 43. The spring seat part 40 may be formed in a depressed shape in one of both surfaces of the inner holder 43, which faces the plate body 34.

Meanwhile, a spring accommodating part 38 in which the other side of the spring 48 is inserted and accommodated may be formed in a depressed shape in the surface of the plate body 34, which faces the magnet 4.

The drive source 5 is installed in the casing 1, and may push the moving pusher 3 to the position at which the movable contact 21 and the fixed contact 22 are contacted with each other. The drive source 5 preferably allows the moving pusher 3 to move at a high speed. The drive source 5 may be disposed to pass through the second conductive casing 13 which will be described later.

The drive source 5 may include an explosive actuator. When the explosive actuator is driven, the piston 51 may apply, to the latch plate 32, an external force greater than the attractive force of the magnet 4.

Hereinafter, for convenience, the same reference numeral is designated to the drive source 5 and the explosive actuator 5.

The explosive actuator 5 may be installed in the casing 1. The explosive actuator 5 may push at least one of the moving part extending rod 31 and the latch plate 32 such that the movable contact 21 and the fixed contact 22 are contacted with each other.

The explosive actuator 5 may include the piston 51 and an inflator 52 for driving the piston 51 by spraying a gas to the piston 51.

The inflator 52 may include a housing 52*a* inside which a space 53 is formed and a gas sprayer 52*b* for spraying the gas into the space 53 of the housing 52*a*.

The piston 51 may be movably disposed in the inflator 52 to be moved at a high speed by the gas sprayed into the space 53.

When the inflator 52 is driven, the piston 51 may advance into the guide hole 47 of the side holder 46 to push the pin 33 located in the guide hole 47 of the side holder 46 in the direction of the vacuum interrupter 2.

If power is applied from the outside, the inflator 52 sprays the gas into the space 53, and the piston 51 is pushed by the gas sprayed into the space 53 to push the latch plate 32 in the direction of the vacuum interrupter 2. Then, the moving part extending rod 31 is pushed by the latch plate 32 to allow the movable contact 21 to be contacted with the fixed contact 22. If a high-pressure gas is sprayed into the space 53 of the housing 52*a*, the piston 51 is rapidly moved by the high-pressure gas.

The housing 52*a* may be disposed inside the casing 1.

The gas sprayer 52*b* may be disposed to be exposed to the outside of the casing 1, and an electric wire 52*c* through which power for driving the gas sprayer 52*b* is applied may be connected to the gas sprayer 52*b*.

The gas sprayer 52*b* may be a gas generator. If a firing signal is applied from the outside, the gas sprayer 52*b* is driven to spray a high-pressure gas into the space 53 of the housing 52*a*.

The first fixing bus-bar 6 may be fixed to the casing 1. The first fixing bus-bar 6 is a fixed-contact-side bus-bar electrically connected to the fixed contact 22, and may be mounted to the casing 1 such that the position of the first fixing bus-bar 6 is fixed.

The second fixing bus-bar 7 may be fixed to the casing 1 to be spaced apart from the first fixing bus-bar 6. The second fixing bus-bar 7 may be a movable-contact-side bus-bar electrically connected to the movable contact 21. The second fixing bus-bar 7 may be connected to the movable contact 21 through the second conductive casing 13 which will be described later, a multi-contactor supporter 12, the multi-contactor 8, and the moving part extending rod 31. The second fixing bus-bar 7 may be installed in the casing 1 to be located at the opposite side of the first fixing bus-bar 6.

The first fixing bus-bar 6 and the second fixing bus-bar 7 may be spaced apart from each other with the casing 1 interposed therebetween. The first fixing bus-bar 6 may be disposed at one side of the casing 1, and the second fixing bus-bar 7 may be disposed at the other side of the casing 1.

The first fixing bus-bar 6 and the second fixing bus bar 7 may be laterally spaced apart from each other with the casing 1 interposed therebetween. When the first fixing bus-bar 6 is located at a left side of the casing 1, the second fixing bus-bar 7 may be located at a right side of the casing 1. When the first fixing bus-bar 6 is located at a right side of the casing 1, the second fixing bus-bar 7 may be located at a left side of the casing 1.

The casing 1 may be disposed between the first fixing bus-bar 6 and the second fixing bus-bar 7, and left and right surfaces of the casing 1 may be protected by the first fixing bus-bar 6 and the second fixing bus-bar 7.

The bypass switch may include at least one moving part conductive member for conducting the multi-contactor 8 and the second fixing bus-bar 7.

The bypass switch may include at least one fixing part conductive member for conducting the fixed contact 22 and the first fixing bus-bar 6.

The bypass switch may include an insulative member disposed between the moving part conductive member and the fixing part conductive member to insulate between the moving part conductive member and the fixing part conductive member.

The casing 1 may include a moving part conductive member for conducting the multi-contactor 8 and the second fixing bus-bar 7.

In addition, the casing 1 may include a fixing part conductive member for conducting the fixed contact 22 and the first fixing bus-bar 6.

When the casing 1 includes at least one of the moving part conductive member and the fixing part conductive member, it is possible to minimize the number of parts of the bypass switch and to simplify the structure of the bypass switch.

The casing 1 may include an insulative member for insulating between the moving part conductive member and the fixing part conductive member. When the casing 1 includes the insulative member, it is possible to minimize the number of parts of the bypass switch and to simplify the structure of the bypass switch.

The casing 1 may include the multi-contactor supporter 12 for supporting the multi-contactor 8. The casing 1 may further include a first conductive casing 14 coupled to the fixed contact 21 and the first fixing bus-bar 6, and the second conductive casing 13 coupled to the multi-contactor supporter 12 and the second fixing bus-bar 7.

Each of the multi-contactor supporter 12 and the second conductive casing 13 may be formed of a conductive material such as aluminum. The multi-contactor supporter 12 and the second conductive casing 13 may be moving part conductive members.

The multi-contactor supporter 12 and the second conductive casing 13 may be configured in a single body. After the multi-contactor supporter 12 and the second conductive casing 13 are configured as separate members from each other, the multi-contactor supporter 12 and the second conductive casing 13 may be fastened to each other by a fastening member P2 such as a screw.

A space in which the multi-contactor 8 is accommodated such that the position of the multi-contactor 8 is fixed may be formed inside the multi-contactor support 12. The multi-contactor supporter 12 may be formed in a hollow shape.

The multi-contactor 8 is located between an inner circumferential surface of the multi-contactor supporter 12 and an outer circumferential surface of the moving part extending rod 31, and an inner circumferential surface of the multi-contactor 8 may be contacted with the outer circumferential surface of the moving part extending rod 31.

A projection 12*a* by which the multi-contactor 8 is held may protrude from the inner circumference of the multi-contactor supporter 12.

The projection 12*a* may protrude in a ring shape from one surface of the multi-contactor supporter 12, which faces the vacuum interrupter 2. The projection 12*a* may be formed to surround a portion of the movable contact 21, which is located at the outside of the inner housing 23 of the vacuum interrupter 2.

The multi-contactor 8 may be accommodated such that one end of the multi-contactor 8 is contacted with the projection 12*a*. The position of the multi-contactor 8 may be maintained without being pushed by the moving part extending rod 31 in a state in which the multi-contactor 8 is held by the projection 12*a*.

The second conductive casing 13 may include a hollow cylindrical body inside which a space is formed. The second conductive casing 13 may further include a plate body for blocking one surface of the hollow cylindrical body.

The latch plate 32 may be movably located inside the second conductive casing 13. The magnet holder 41 may be disposed inside the second conductive casing 13 such that the position of the magnet holder 41 is fixed.

The magnet holder 41 may be fixed to the second conductive casing 13 by the fastening member P1. The fastening member P1 may be fastened into a fastening hole formed in the outer holder 42 by sequentially passing through a fastening hole formed in the second conductive casing 13 and a fastening hole formed in the side holder 46. The second conductive casing 13 may serve as a magnet holder mounter in which the magnet holder 41 is mounted.

A hollow cylindrical part 17 surrounding a portion of the drive source 5 may protrude from the second conductive casing 13. A drive source accommodating space in which a portion of the drive source 5 is accommodated may be formed inside the hollow cylindrical part 17. The hollow cylindrical part 17 may be formed to surround the housing 52*a* of the inflator 52 constituting the drive source 5.

The drive source 5 may be installed such that the housing 52*a* is inserted into the hollow cylindrical part 17 of the second conductive casing 13. An end portion of the housing 52*a* of the inflator 52 may be inserted into the magnet holder 41, particularly, the drive source accommodating groove 46*a* of the side holder 46.

A hollow cylindrical part through-hole 71 through which the hollow cylindrical part 17 passes may be formed in the second fixing bus-bar 7.

The second fixing bus-bar 7 may include a contact plate body 72 contacted with the second conductive casing 13, and a bending part 73 bent from the contact plate body 72, the bending part 73 being parallel to the direction in which the drive source 5 protrudes to the outside.

The hollow cylindrical part through-hole 71 may be formed in the contact plate body 72 of the second fixing bus-bar 7. One of both surfaces of the contact plate body 72 of the second fixing bus-bar 7, which faces an outer surface of the second conductive casing 13, may be surface-contacted with the outer surface of the second conductive casing 13. A circumferential surface of the hollow cylindrical part through-hole 71 formed in the contact plate body 72 of the second fixing bus-bar 7 may be surface-contacted to an outer circumferential surface of the hollow cylindrical part 17 of the second conductive casing 13.

The first conductive casing 14 may be formed of a conductive material such as aluminum. The first conductive casing 14 may be a fixing part conductive member.

The casing 1 may further include an insulative casing 15 disposed between the multi-contactor supporter 12 and the first conductive casing 14.

The insulative casing 15 may be fastened to the multi-contactor supporter 12 by a fastening member such as a screw. Fastening member fastening holes into which the fastening member is inserted may be formed to face each other in the insulative casing 15 and the multi-contactor supporter 12.

The insulative casing 15 may surround the vacuum interrupter 2 at the outside of the vacuum interrupter 2. The insulative casing 15 may be formed in the shape of a hollow cylindrical body, and a vacuum interrupter accommodating space 16 in which the vacuum interrupter 2 is accommodated may be formed inside the insulative casing 15. The vacuum interrupter 2 may be accommodated in the insulative casing 15 to be supported by the insulative casing 15, and the vacuum interrupter 2 is not exposed to the outside.

When the casing 1 does not surround the outer circumference of the vacuum interrupter 2, and a portion of the vacuum interrupter 2 is exposed to the outside, the possibility that the vacuum interrupter 2 will be broken may be high. When the casing 1, particularly, the insulative casing 15 surrounds the outer circumference of the vacuum interrupter 2, the possibility that the vacuum interrupter 2 will be broken can be minimized.

A fastening member through-hole 141 through which the fastening member P3 fastening the first conductive casing 14 to the insulative casing 15 passes may be formed in the first conductive casing 14. The first conductive casing 14 may be coupled to the insulative casing 15 through the fastening member through-hole 141. The fastening member P3 may be fastened into an insulative casing fastening hole 151 formed in the insulative casing 15 by passing through the fastening member through hole 141 formed in the first conductive casing 14.

The first conductive casing 14 may be fastened to the fixed contact 22 through a fastening member P4 such as a screw. A central through-hole 142 through which the fastening member P4 passes may be formed in the first conductive casing 14.

A fixed contact fastening hole 222 into which the fastening member P4 is fastened may be formed at a portion of the fixed contact 22, which protrudes to the outside of the inner housing 23. The fastening member P4 may be fastened into the fixed contact fastening hole 222 of the fixed contact 22 by passing through the central through-hole 142 of the first conductive casing 14.

Meanwhile, the first fixing bus-bar 6 may be disposed to cover the fastening member through-hole 141 and the fastening member P4. The fastening member P4 fastening the first conductive casing 14 to the insulative casing 15 may be covered by the first fixing bus-bar 6. An avoiding hole 61 for avoiding the fastening member P4 fastening the first conductive casing 14 to the fixed contact 22 may be formed in the first fixing bus-bar 6.

The first fixing bus-bar 6 may include a contact plate body 62 contacted with the first conductive casing 14, and a bending part 63 bent from the contact plate body 62, the bending part 63 being bent in a direction opposite to that of the bending part 73 of the second fixing bus-bar 7.

A surface of the contact plate body 62 of the first fixing bus-bar 6, which faces an outer surface of the first conductive casing 14, may be surface-contacted with the outer surface of the first conductive casing 14.

The multi-contactor 8 may be disposed to be contacted with the moving pusher 3. The multi-contactor 8 may be disposed to be contacted with at least one of the moving part extending rod 31 and the latch plate 32. The multi-contactor 8 may be disposed to be contacted with the moving part extending rod 31 out of the moving part extending rod 31 and the latch plate 32. The multi-contactor 8 may be formed of a conductive material such as aluminum. The multi-contactor 8 may be contacted with the moving pusher 3 in a state in which the position of the multi-contactor 8 is fixed.

The multi-contactor 8 may be disposed such that a plurality of points of the multi-contactor 8 are contacted with the moving pusher 3. A plurality of points of the multi-contactor 8 may be contacted with the moving pusher not only after the drive source 5 is driven but also before the drive source 5 is driven.

The multi-contactor 8, as shown in FIG. 6, may include a contact part 81 contacted with the moving pusher 3. The contact part 81 may be provided in plurality to the multi-contactor 8. A plurality of points of the multi-contactor 8 may be contacted with the plurality of contact parts 81. In this case, it is possible to improve reliability.

The multi-contactor 8 may further include an outer body part 82 surrounding the outer circumference of the moving pusher 3.

The contact part 81 may protrude from the outer body part 82 to be contacted with the moving pusher 3. The contact part 81 may protrude from the outer body part 82 to be contacted with the moving part extending rod 31.

The outer body part 82 may be disposed to be spaced apart from the moving pusher 3. The outer body part 82 may be a non-contact part not contacted with the moving pusher 3.

The entire inner circumference of the multi-contactor 8 is not contacted with the moving pusher 3, and only the plurality of contact parts 81 may be contacted with the moving pusher 3.

A gap G may be formed between the outer body part 82 and the moving part extending rod 31. The moving part extending rod 31 is not surface-contacted with an inner circumferential surface of the outer body part 82, and may be rapidly moved when the explosive actuator 5 is driven.

In addition, a plurality of contacts of the plurality of contact parts 81 are contacted with the moving part extending rod 31, so that it is possible to improve the reliability of electrical connection.

The outer body part 82 may include a hollow cylindrical body surrounding a portion of the moving pusher 3. The hollow cylindrical body may be disposed to be spaced apart from the moving pusher 3 between the moving pusher 3 and the multi-contactor supporter 12. The hollow cylindrical body may have a bore spaced apart from an outer surface of the moving pusher.

The hollow cylindrical body may surround a portion of the moving part extending rod 31 in the moving pusher 3. The hollow cylindrical body may be disposed to be spaced apart from the moving part extending rod 31 between the moving part extending rod 31 and the multi-contactor supporter 12. The hollow cylindrical body may have a bore spaced apart from the protruding part 31*a* of the moving part extending rod 31.

The plurality of contact parts 81 may be integrally formed with the outer body part 82. Each of the plurality of contact parts 81 may be a protrusion protruding from the inner circumference of the hollow cylindrical body.

The plurality of contact parts 81 may be spaced apart from each other in the circumferential direction of the hollow cylindrical body. The plurality of contact parts 81 may be formed long in a direction parallel to the length direction of the moving part extending rod 31.

Hereinafter, the operation of the present disclosure configured as described above will be described as follows.

First, if a firing signal is applied to the drive source 5 from the outside, the drive source 5 may push the piston 51 in the direction of the vacuum interrupter 2. When the firing signal is applied, the inflator 52 may spray a high-pressure gas into the space 53 of the housing 52*a*, and the piston 51 may be move forward in the direction of the vacuum interrupter 2 by the high-pressure gas sprayed into the space 53 of the housing 52*a*.

When the piston 51 is moved forward, the piston 51 may push the moving pusher 3 in the direction of the vacuum interrupter 2. The piston 51 may apply, to the latch plate 32, an external force greater than an attractive force of the magnet 4, and the latch plate 32 may become close to the vacuum interrupter 2 while being distant from the magnet 4. The latch plate 32 moved by the piston 51 may push the moving part extending rod 31.

The moving part extending rod 31 may be slid inside the multi-contactor 8 in a state in which the moving part extending rod 31 is contacted with the plurality of contact parts 81 of the multi-contactor 8. When the moving part extending rod 31 is slid, the moving part extending rod 31 may be moved in the direction of the vacuum interrupter 2 while maintaining contact with the plurality of contact parts 81.

The moving part extending rod 31 may be slid between the plurality of contact parts 81 while not being surface-contacted with the inner circumferential surface of the outer body part 82. The moving part extending rod 31 may be slid faster than when the moving part extending rod 31 is surface-contacted with the inner circumferential surface of the outer body part 82.

When the moving part extending rod 31 is slid as described above, the movable contact 21 connected to the moving part extending rod 31 may advance toward the fixed contact 22. The movable contact 21 may be contacted with the fixed contact 22.

When the latch plate 32 is moved as described above, the spring 48 may push the latch plate 32 in the direction of the vacuum interrupter 2 while being elastically restored. The latch plate 32, the moving part extending rod 31, and the movable contact 21 are not returned to their original positions by a force with which the spring 48 pushes the latch plate 32, and the movable contact 21 may maintain contact with the fixed contact 22.

When the spring 48 does not press the latch plate 32 in the direction of the vacuum interrupter 2, the piston 51 may be treated in the direction of the gas sprayer 52*b* by vibration, etc. after the explosive actuator 5 is fired. In this case, the gas in the housing 52*a* may be leaked, and the movable contact 21 may be separated from the fixed contact 22 due to the retreat of the piston 51 and the leakage of the gas.

However, when the spring 48 presses the latch plate 32 in the direction of the vacuum interrupter 2 as described above, the retreat of the piston 51 in the direction of the gas sprayer 52*b* can be minimized, and the leakage of the gas in the housing 52*a* can also be minimized. Accordingly, it is possible to improve the reliability of the contact between the movable contact 21 and the fixed contact 22.

When the movable contact 21 and the fixed contact 22 are contacted with each other as described above, the fixed contact 22 and the multi-contactor 8 can be electrically conducted by the movable contact 21 and the moving part extending rod 31. In addition, the first fixing bus-bar 6 and the second fixing bus-bar 7, as shown in FIG. 4, can be electrically conducted through the first conductive casing 14, the fixed contact 22 and the movable contact 21, the moving part extending rod 31, the multi-contactor 8, the multi-contactor supporter 12, and the second conductive casing 13. The first conductive casing 14, the fixed contact 22 and the movable contact 21, the moving part extending rod 31, the multi-contactor 8, the multi-contactor supporter 12, and the second conductive casing 13, as shown in FIG. 4, can form a path through which the first fixing bus-bar 6 and the second fixing bus-bar 7 are electrically conducted.

That is, the bypass switch can be short-circuited, and current can flow through the bypass switch.

Figure 7:
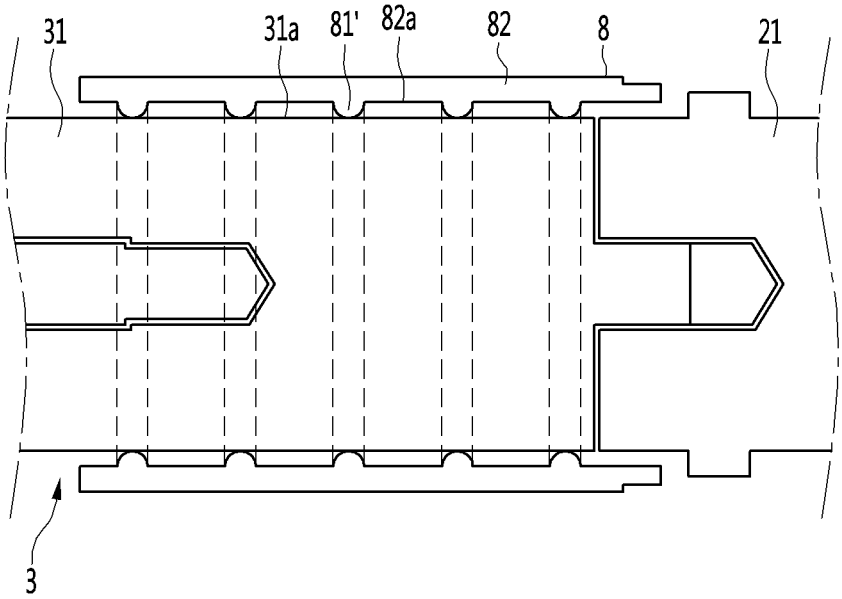
FIG. 7 is an enlarged sectional view of a main part of a bypass switch according to a second embodiment.

FIG. 7 is an enlarged sectional view of a main part of a bypass switch according to a second embodiment.

In this embodiment, the shape of a contact part 81' is different from that of the contact part 81 of the first embodiment. However, other components except the contact part 81' are identical or similar to those of the first embodiment, and therefore, their detailed descriptions will be omitted.

The contact part 81' of this embodiment may be formed in a ring shape along an inner circumferential surface 82*a* of an outer body part 82. The contact part 81' may be provided in plurality to the inner circumferential surface 82*a* of the body part 82, and the plurality of contact parts 81' may be spaced apart from each other in the length direction of the outer body part 82. An outer surface of a moving part extending rod 31 of the moving pusher 3 may be contacted with an inner circumferential surface of each of the plurality of contact parts 81'. A plurality of points of the moving part extending rod 31 of the moving pusher 3 may be contacted with a multi-contactor.

Figure 8:
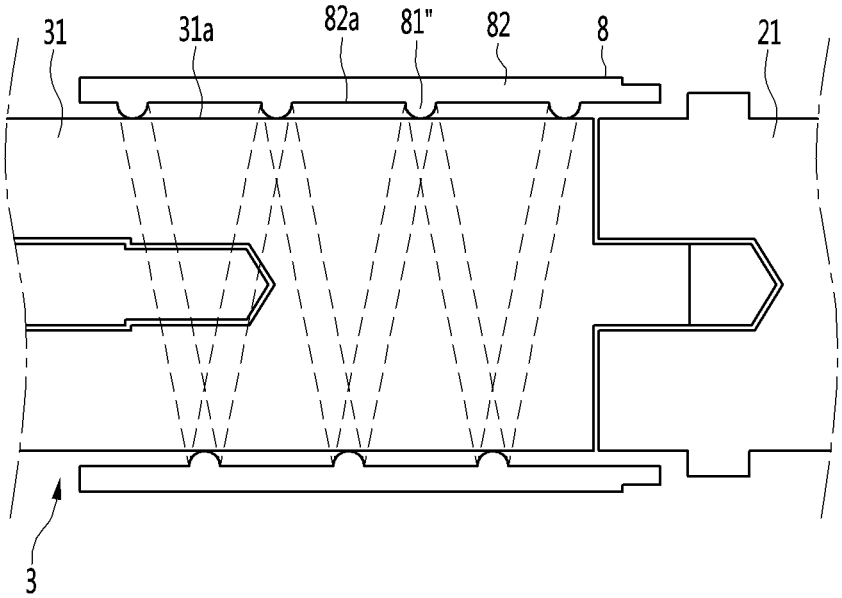
FIG. 8 is an enlarged sectional view of a main part of a bypass switch according to a third embodiment.

FIG. 8 is an enlarged sectional view of a main part of a bypass switch according to a third embodiment.

In this embodiment, the shape of a contact part 81" is different from those of the contact part 81 of the first embodiment and the contact part 81' of the second embodiment. However, other components except the contact part 81" are identical or similar to those of the first embodiment and the second embodiment, and therefore, their detailed descriptions will be omitted.

The contact part 81" of this embodiment may be configured as a spiral contact part spirally protruding along the inner circumference of an outer body part 82, and the spiral contact part may be contacted with a moving pusher 3.

An outer surface of a moving part extending rod 31 of the moving pusher 3 may be continuously contacted along the contact part 81".

Figure 9:
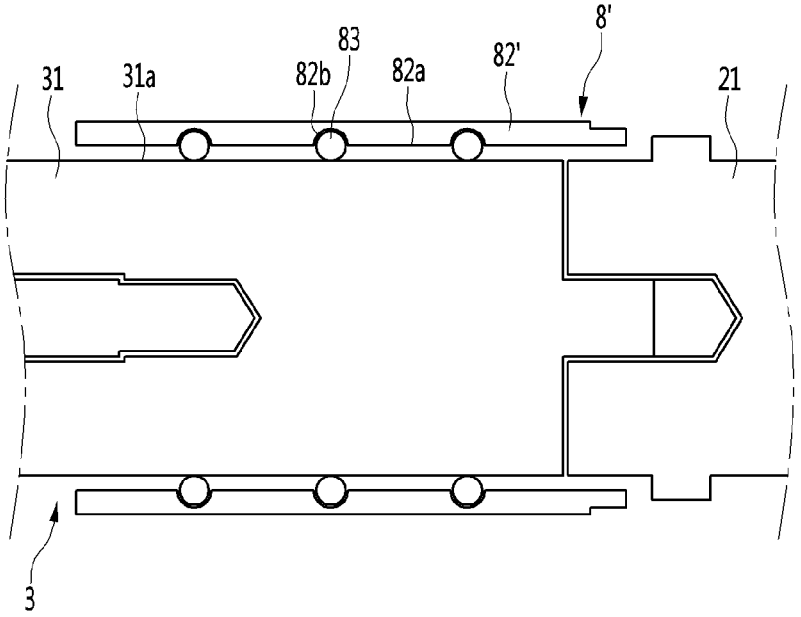
FIG. 9 is an enlarged sectional view of a main part of a bypass switch according to a fourth embodiment.

FIG. 9 is an enlarged sectional view of a main part of a bypass switch according to a fourth embodiment.

In this embodiment, the configuration of a multi-contactor 8' is different from those of the first to third embodiments. However, other components except the multi-contactor 8' are identical or similar to those of the first to third embodiments, and therefore, their detailed descriptions will be omitted.

The multi-contactor 8' may include an outer body 82' having a ball insertion groove 82*b* formed in an inner circumferential surface 82*a* thereof, and a ball 83 inserted into the ball insertion groove 82*b*, the ball 83 being contacted with an outer surface of a moving pusher 3.

The outer body 82' is a component corresponding to the outer body part 82 of the first embodiment. The configuration of the outer body 82' except that the ball insertion groove 82*b* is formed in the inner circumferential surface 82*a* is identical to that of the outer body part 82 of the first embodiment, and therefore, its detailed description will be omitted.

The ball 83 may be located to be rollable in the ball insertion groove 82*b*. When the moving pusher 3 is moved, the ball 83 may roll along the moving pusher 3 in a state in which the ball 83 is contacted with the outer surface of the moving pusher 3.

A plurality of ball insertion grooves 82*b* may be formed in the outer body 82'. The multi-contactor 8' may include a plurality of balls 83, and the balls 83 and the ball insertion grooves 82*b* may be provided to correspond one by one.

The plurality of ball insertion grooves 82*b* may be spaced apart from each other in the length direction of the outer body 82'. In this case, the plurality of balls 83 may be contacted with the moving pusher 3 in a state in which the plurality of balls 83 are disposed to be spaced apart from each other in the length direction of the outer body 82'. The plurality of ball insertion grooves 82*b* may be spaced apart from each other in the circumferential direction of the outer body 82'. In this case, the plurality of balls 83 may be contacted with the moving pusher 3 in a state in which the plurality of balls 83 are disposed to be spaced apart from each other in the circumferential direction of the outer body 82'. An outer surface of a moving part extending rod 31 of the moving pusher 3 may be disposed to be contacted with the plurality of balls 83. Current flowing in the bypass switch can flow in the outer body 82' through the moving part extending rod 31 and the plurality of balls 83.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A bypass switch comprising:

a casing;

a vacuum interrupter disposed inside the casing, the vacuum interrupter being disposed such that a movable contact is movable to a fixed contact;

a first fixing bus-bar fixed to the casing;

a second fixing bus-bar fixed to the casing to be spaced apart from the first fixing bus-bar;

a moving pusher connected to the movable contact;

a drive source installed in the casing, the drive source pushing the moving pusher to a position at which the movable contact and the fixed contact are contacted with each other; and a multi-contactor disposed to be contacted with the moving pusher, wherein the multi-contactor comprises an outer body part surrounding an outer circumference of the moving pusher, the outer body part being spaced apart from the moving pusher, and a contact part protruding from the outer body part to be contacted with the moving pusher, wherein the outer body part and the contact part are formed as a single body, wherein the moving pusher comprises a moving part extending rod connected to the movable contact, and a latch plate connected to the moving part extending rod, wherein the contact part is contacted with the moving part extending rod, wherein a magnet allowing the movable contact to be spaced apart from the fixed contact by applying an attractive force to the latch plate is disposed inside the casing, and when the drive source is driven, a piston is driven to apply, to the latch plate, an external force greater than the attractive force, wherein the latch plate comprises a pin to which the piston applies an external force, and a plate body facing at least one portion of the magnet, and wherein a pin insertion part in which an insertion hole having the pin inserted thereinto is formed at one surface of the plate body, and a connecting part connected to the moving part extending rod is formed at another surface of the plate body.

2. The bypass switch according to claim 1, wherein the contact part is provided in plurality, and the plurality of contact parts are formed to be spaced apart from each other in a circumferential direction of the outer body part.

3. The bypass switch according to claim 1, wherein the contact part is formed long in a direction parallel to a length direction of the moving part extending rod.

4. The bypass switch according to claim 1, comprising a magnet holder disposed inside the casing to fix the magnet.

5. The bypass switch according to claim 4, further comprising a spring elastically supporting the latch plate in a direction in which the movable contact and the fixed contact are contacted with each other.

6. The bypass switch according to claim 5, wherein a spring seat part is formed in the magnet holder, wherein a portion of the spring is inserted and accommodated in the spring seat part, and the spring seat part supports the spring.

7. The bypass switch according to claim 1, wherein the casing comprises a multi-contactor supporter supporting the multi-contactor, the multi-contactor supporter being formed of a conductive material.

8. The bypass switch according to claim 7, wherein a projection by which the multi-contactor is held protrudes from an inner circumference of the multi-contact supporter.

9. The bypass switch according to claim 7, wherein the casing further comprises:

a first conductive casing coupled to the fixed contact and the first fixing bus-bar; and a second conductive casing coupled to the multi-contactor supporter and the second fixing bus-bar.

10. The bypass switch according to claim 9, wherein the second fixing bus-bar comprises:

a contact plate body contacted with the second conductive casing; and a bending part bent from the contact plate body, the bending part being parallel to a direction in which the drive source protrudes to an outside.

11. The bypass switch according to claim 9, wherein the casing further comprises an insulative casing disposed between the multi-contactor supporter and the first conductive casing, and the insulative casing surrounds the vacuum interrupter at an outside of the vacuum interrupter.

12. The bypass switch according to claim 11, wherein the multi-contactor supporter is disposed between the second conductive casing and the insulative casing.

13. The bypass switch according to claim 1, wherein the outer body part comprises a hollow cylindrical body surrounding a portion of the moving pusher, the hollow cylindrical body is disposed to be spaced apart from the moving pusher between the moving pusher and the multi-contactor supporter, and the contact part is a protrusion protruding from an inner circumference of the hollow cylindrical body.

14. The bypass switch according to claim 13, wherein the hollow cylindrical body has a bore spaced apart from an outer surface of the moving pusher.

15. A bypass switch comprising:

a casing;

a vacuum interrupter disposed inside the casing, the vacuum interrupter being disposed such that a movable contact is movable to a fixed contact;

a first fixing bus-bar fixed to the casing;

a second fixing bus-bar fixed to the casing to be spaced apart from the first fixing bus-bar;

a moving pusher connected to the movable contact;

a drive source installed in the casing, the drive source pushing the moving pusher to a position at which the movable contact and the fixed contact are contacted with each other; and a multi-contactor disposed to be contacted with the moving pusher, wherein the casing comprises a multi-contactor supporter supporting the multi-contactor, the multi-contactor supporter being formed of a conductive material, wherein the casing further comprises:

a first conductive casing coupled to the fixed contact and the first fixing bus-bar; and a second conductive casing coupled to the multi-contactor supporter and the second fixing bus-bar, wherein a hollow cylindrical body surrounding a portion of the drive source protrudes from the second conductive casing, and a hollow cylindrical body through-hole through which the hollow cylindrical body passes is formed in the second fixing bus-bar.

16. A bypass switch comprising:

a casing;

a vacuum interrupter disposed inside the casing, the vacuum interrupter being disposed such that a movable contact is movable to a fixed contact;

a first fixing bus-bar fixed to the casing;

a second fixing bus-bar fixed to the casing to be spaced apart from the first fixing bus-bar;

a moving pusher connected to the movable contact;

a drive source installed in the casing, the drive source pushing the moving pusher to a position at which the movable contact and the fixed contact are contacted with each other; and a multi-contactor disposed to be contacted with the moving pusher, wherein the casing comprises a multi-contactor supporter supporting the multi-contactor, the multi-contactor supporter being formed of a conductive material, wherein the casing further comprises:

a first conductive casing coupled to the fixed contact and the first fixing bus-bar; and a second conductive casing coupled to the multi-contactor supporter and the second fixing bus-bar, wherein the casing further comprises an insulative casing disposed between the multi-contactor supporter and the first conductive casing, and the insulative casing surrounds the vacuum interrupter at an outside of the vacuum interrupter, wherein a fastening member through-hole through which a fastening member fastening the first conductive casing to the insulative casing passes is formed in the first conductive casing, and the first fixing bus-bar covers the fastening member through-hole and the fastening member.

* * * * *